United States Patent [19]

Hisada

[11] 4,142,835

[45] Mar. 6, 1979

[54] PITCH CONTROLLING DEVICE OF A MARINE PROPELLER

[75] Inventor: Naoji Hisada, Tokyo, Japan

[73] Assignee: Chuetsu Waukesha Kabushiki Kaisha, Tokyo, Japan

[21] Appl. No.: 775,055

[22] Filed: Mar. 7, 1977

[30] Foreign Application Priority Data

Jul. 14, 1976 [JP] Japan ..... 51-84178

[51] Int. Cl.[2] ..... B63H 3/08

[52] U.S. Cl. ..... 416/162; 416/157 R

[58] Field of Search ..... 416/162, 164, 149, 150, 416/167, 157

[56] References Cited

U.S. PATENT DOCUMENTS

| | | | |
|---|---|---|---|
| 2,414,229 | 1/1947 | Johansen | 416/161 X |
| 2,582,559 | 1/1952 | Pearson | 416/167 |
| 2,946,317 | 7/1960 | Klassen et al. | 416/162 |
| 3,000,447 | 9/1961 | Baugher | 416/164 |
| 3,173,343 | 3/1965 | Berry | 416/162 X |
| 3,216,507 | 11/1965 | Curioni | 416/162 X |
| 3,338,313 | 8/1967 | Tolley et al. | 416/162 X |
| 3,395,762 | 8/1968 | Itazawa | 416/162 |

FOREIGN PATENT DOCUMENTS

| | | | |
|---|---|---|---|
| 448239 | 5/1948 | Canada | 416/61 |
| 729860 | 1/1943 | Fed. Rep. of Germany | 416/162 |
| 46-4221 | 12/1971 | Japan | 416/162 |

*Primary Examiner*—Everette A. Powell, Jr.

*Attorney, Agent, or Firm*—Burns, Doane, Swecker & Mathis

[57] ABSTRACT

A relative motion between a solid propeller shaft and a sleeve surrounding the propeller shaft is utilized to control a pitch of a marine propeller; the front end of the sleeve being supported by a pair of taper roller bearings and the rear end of the sleeve being connected to the hub of the propeller. A bearing housing supporting the taper roller bearings is formed as a piston of a servomotor and a casing receiving the bearing housing is formed as a cylinder of the servomotor. The casing is formed as a common oil reservoir for feeding lubricating oil to a stern tube bearing and bearings in the hub of the propeller.

2 Claims, 4 Drawing Figures

PITCH CONTROLLING DEVICE OF A MARINE PROPELLER

BACKGROUND OF THE INVENTION

This invention relates to a pitch controlling device of a marine propeller.

In the case of prior art, a servomotor for controlling the pitch of a propeller is provided generally in a hub of the propeller, or in a shafting as shown in FIG. 1 and FIG. 2. And, owing to the provision or a servomotor in hub or in shafting, they are obliged to use a stationary member embracing a rotating member to introduce pressure oil to the servomotor, and further, the oil passages in the hub and in shafting are relatively complex. Therefore, in these devices, a leakage of oil rises to a fairly large amount and it often causes an inaccurate operation. These kind of devices include also various parts which are arranged in spaces of low accessibility. Thus, in the case of prior art, a relatively long time and a fairly large amount of cost are necessary for the repairing of the parts.

Further, in the cases of above heretofore known devices, the shaft of the propeller must be provided with a long center bore and branch bores for the feeding of oil or for the provision of a force transmitting member. And, upon providing these bores, it is necessary to use special machine tools.

SUMMARY OF THE INVENTION

The principal object of the present invention is to provide a pitch controlling device of a marine propeller which is not accompanied with the above mentioned defects and which is simple in construction, easy in maintenance and accurate in operation.

More particularly, a sleeve surrounds and rotates with a solid propeller shaft terminating rearwardly in a hub in which the propeller blades are mounted in such manner that their pitch can be changed by effecting relative motion between the sleeve and shaft. A pair of thrust bearings for supporting the front end of the sleeve are themselves supported within a housing which also functions as the piston component of a double-acting servomotor. A casing which receives the bearing housing is provided in the hull of the vessel and also functions as the cylinder component of the servomotor, and a change in pitch of the propeller blades is accomplished by introducing pressurized oil selectively into one or the other end of the cylinder.

BRIEF DESCRIPTION OF DRAWINGS

Other object and advantages will be apparent in the following description taken in connection with the annexed drawings in which.

DETAILED DESCRIPTION OF PREFERRED EMBODIMENT

Figure 1:
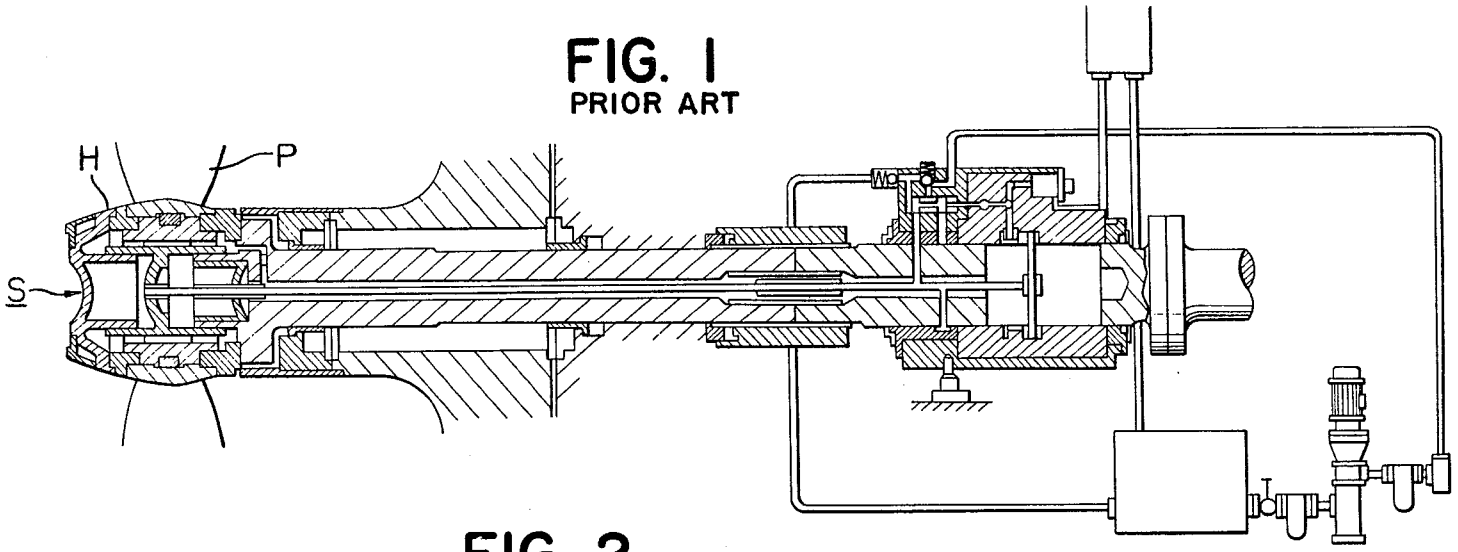
FIG. 1 PRIOR ART
FIG. 1 is a longitudinally sectioned view of a heretofore known type of "servomotor in hub"
Figure 2:
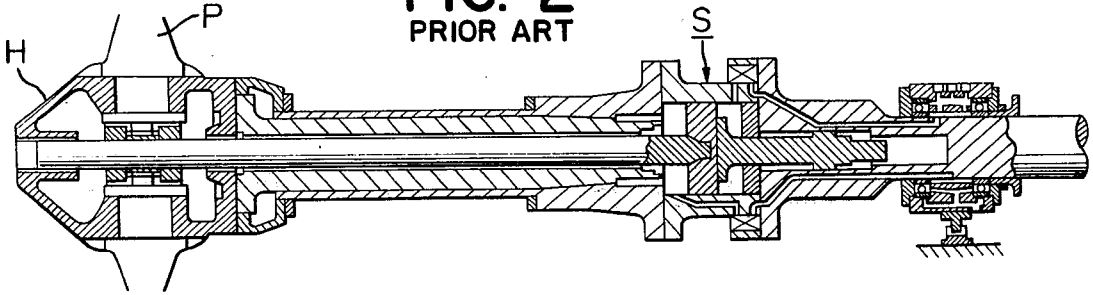
FIG. 2 PRIOR ART
FIG. 2 is a similar view of a heretofore known type of "servomotor in shafting"

Referring to the drawings, there are shown two examples of prior art in FIG. 1 and FIG. 2. In FIG. 1, a servomotor S is provided within a hub H of the propeller and in FIG. 2, a servomotor S is provided as a part of shafting. The constructions shown in these figures are well known, and they are accompanied with defects already explained.

Figure 3:
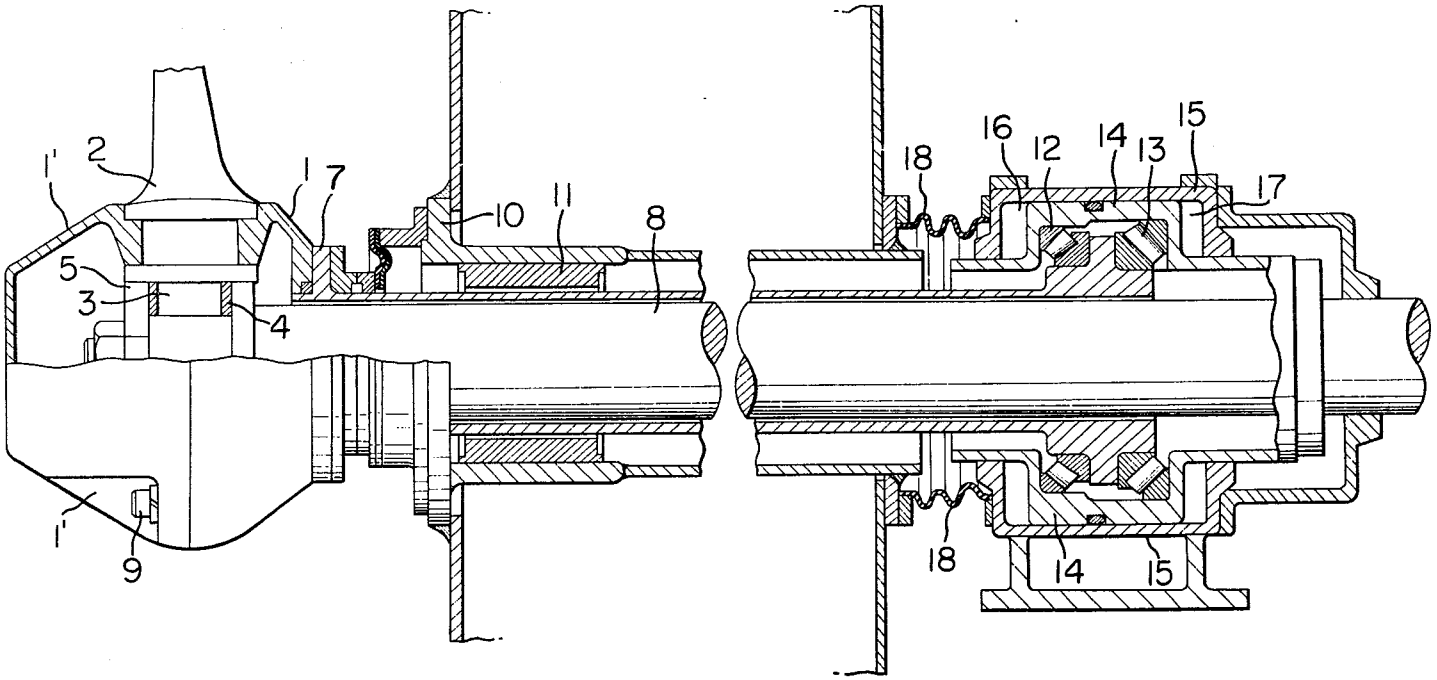
FIG. 3 is a longitudinally sectioned view of a pitch controlling device of a marine propeller according to the present invention.
Figure 4:
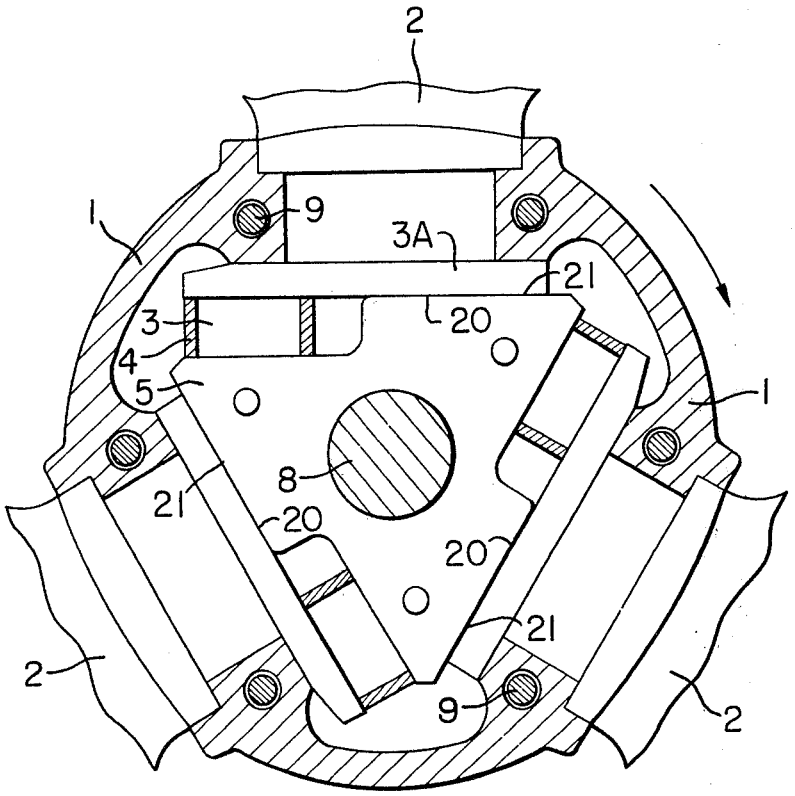
FIG. 4 is an elevation showing a propeller hub, root portions of propeller-blades and a shifter of the device shown in FIG. 3.

FIG. 3 and FIG. 4 show a pitch controlling device of a marine propeller according to the present invention. Referring now to these drawings, a propeller hub is composed of front and rear portions 1, 1' which are connected together by several fastening bolts 9. Each of the propeller blades 2 is supported by the propeller hub 1, 1' for rotation about a pitch adjusting axis and is provided with a crank pin 3 for pitch adjustment at its root or base portion 3A. A shifter 5 is fixed to a propeller shaft 8. Recesses for receiving bearing bushes 4 of square cross section are formed on the shifter 5, and each of the bearing bushes 4 engages with the crank pin 3 provided at the root portion of the propeller blade 2. The shifter 5 includes a plurality of drive surfaces 20 which engage surfaces 21 on the root portions of the blades to drive the hub as the drive shaft is rotated. The propeller shaft 8 is solid, and it is surrounded by a sleeve 7. The front portion of the sleeve 7 is supported by a pair of taper roller bearings 12, 13 and the rear end of the sleeve 7 is fixed to the front portion 1 of the propeller hub. Therefore, the propeller shaft 8 rotates with the sleeve 7. The taper roller bearings 12, 13 are members which are accommodated within a hull. The propeller shaft 8 is supported by a stern tube 10 with a stern tube bearing 11. Thrusting forces acting on the propeller blades are transmitted to the taper roller bearings 12, 13 through the sleeve 7. As the torque for driving the propeller is not transmitted to the sleeve 7 substantially, the sleeve 7 can be manufactured as one which has a thickness of only a few percent of the diameter of the propeller shaft 8.

The taper roller bearings 12, 13 are supported by a housing 14 which operates as a piston in a cylinder-portion of a casing 15. The cylinder portion of the casing 15 and the housing 14 constitute a servomotor with pressure chambers 16, 17 into which pressure oil will be introduced through a regulating device (not shown). The casing 15 is a member fixed to a hull, and a portion of this member (not shown) serves as an oil reservoir too. Oil from the oil reservoir can be conducted to this common system in any convenient fashion.

Feeding of oil to the stern tube bearing 11 and that of propeller hub 1, 1' can be carried out through a common system by connecting the front end of the stern tube 10 to the rear end of the casing 15 by means of a flexible oil-proof member 18. The above common system can be obtained also by providing the casing 15 within the stern tube 10.

The bearing housing 14 is moved axially to reach a desired position by introducing oil into one of the pressure chambers 16, 17 through a pilot valve which is operated by a signal for controlling the pitch of the propeller.

It is possible to use bearings of the thrust-pad type in lieu of the taper roller bearings 12, 13. However, the use of the taper roller bearings, particular use of a spherical taper roller bearings is preferable, because they have an extremely long life. Since the spherical roller bearings bear radial load, and further, because they have a self-aligning property, the job of shaft-aligning at the time of installation becomes very easy in comparison with the case of the prior art.

The pitch change from astern to ahead is carried out by operating a handle so as to introduce oil into the pressure chamber 17. The piston of the servomotor, that is to say the housing 14 of the taper roller bearings 12, 13 moves rearwardy to an ordered position carring the sleeve 7 and the propeller hub 1, 1' fixed to the sleeve 7. Since the propeller shaft 8 can not move axially, a relative motion occurring between the propeller shaft 8 and the propeller hub 1, 1' turns the propeller blades 2 so as to change their pitch from astern to ahead. Similarly, a change from ahead to astern is carried out by operating the handle so as to introduce oil into the pressure chamber 16.

In the above explained construction, a great part of the thrust forces acting on the blades of the propeller is stopped at the portion of the taper roller bearings 12, 13 relieving severe conditions on the design of speed reduction gearing or other elements. Further, since a part of the casing 15 is formed also as an oil reservoir, sealing members can be accomodated simply.

I claim:

1. A pitch controlling device for the propeller blades of a marine vessel including a hull, comprising:

a solid propeller shaft;

a sleeve surrounding said propeller shaft and being movable longitudinally relative thereto;

a hub mounted to a rear end of said sleeve;

a plurality of blades mounted in said hub for rotation relative thereto about a pitch adjusting axis, each blade including a base portion at its radially inner end;

a shifter fixed to said drive shaft for rotation therewith;

said shifter disposed in said hub and including drive surfaces contacting said base portions of said blades to rotate the hub in response to rotation of said drive shaft;

means interconnecting said blades and said shifter to produce rotation of said blades about said pitch adjusting axle in response to relative longitudinal movement between said drive shaft and said sleeve;

a casing fixed to said hull;

a bearing housing movably mounted within said casing to form closed chambers therewith on opposite ends of said bearing housing, such that the introduction of pressurized fluid into either of said chambers produces movement of said bearing housing in a direction opposite such chamber; and a pair of thrust bearings mounted in said bearing housing and supporting a front end of said sleeve such that movement of said bearing housing moves said sleeve longitudinally relative to said drive shaft to rotate said blades about their pitch adjusting axes.

2. A pitch controlling device according to claim 1, wherein said thrust bearings comprise spherical taper roller bearings.

* * * * *